US005975596A

United States Patent [19]

Rogers, Jr. et al.

[11] Patent Number: 5,975,596

[45] Date of Patent: Nov. 2, 1999

[54] VEHICLE DOOR LATCH

[75] Inventors: Lloyd Walker Rogers, Jr., Shelby Township, Macomb County; Reginald Leo McDonald, Macomb Township, Macomb County, both of Mich.

[73] Assignee: General Motors Corporation, Detroit, Mich.

[21] Appl. No.: 09/106,316

[22] Filed: Jun. 29, 1998

[51] Int. Cl.[6] ..... E05C 3/06

[52] U.S. Cl. ..... 292/216; 292/DIG. 23; 292/DIG. 65

[58] Field of Search ..... 292/216, DIG. 23, 292/169.11, 336.3, DIG. 27, DIG. 30, DIG. 65

[56] References Cited

U.S. PATENT DOCUMENTS 4,492,395 1/1985 Yamada ..... 292/216

5,100,185 3/1992 Menke et al. ..... 292/216

5,277,461 1/1994 Dzurko et al. ..... 292/216

5,803,515 9/1998 Arabia, Jr. et al. ..... 292/216

*Primary Examiner*—Steven Meyers

*Assistant Examiner*—Clifford B Vaterlaus

*Attorney, Agent, or Firm*—Charles E. Leahy; Kathryn A. Marra

[57] ABSTRACT

A vehicle door latch has a locking mechanism and a latching mechanism and inside and outside handle levers for unlatching the vehicle door latch. Each handle lever cooperates with the locking mechanism and the latching mechanism independently of the other so that the vehicle door latch can be unlocked and unlatched by one handle lever when the other handle lever is stuck in an unlatched position.

11 Claims, 9 Drawing Sheets

VEHICLE DOOR LATCH

This invention relates generally to a vehicle door latch and more particularly to a vehicle door latch that has a latching mechanism for operating the vehicle door latch and a locking mechanism for disabling the latching mechanism.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well-known manner to latch the door when it is closed and to lock the door in the closed position and to unlock and unlatch the door so that the door can be opened manually.

The door latch is operated remotely from the exterior of the automobile by two distinct operators—a key cylinder that controls the locking mechanism and an outside door handle or push button that controls the latching mechanism.

The door latch is also operated remotely from inside the passenger compartment by to distinct operators—a sill button that controls the locking mechanism and a handle that controls the latching mechanism. Vehicle door latches for upscale automobiles may also include power door locks in which the locking mechanism is motor driven and/or a keyless entry in which a key fob transmitter sends a signal to a receiver in the vehicle to operate the motor driven locking mechanism.

U.S. Pat. No. 5,277,461 granted to Thomas A. Dzurko et al Jan. 11, 1997 for a vehicle door latch, which is hereby incorporated in this patent specification by reference, discloses a typical door latch of the above noted type. The door latch disclosed in the Dzurko '461 patent includes an unlatching lever 60 that is pivotally mounted on a stud 28 that is secured to a metal back plate 16 and a metal face plate 14 at opposite ends. Unlatching lever 60 is operated to unlatch the vehicle door by an inside handle lever 56 that is connected by a suitable linkage for rotation by an inside door handle (not shown). Unlatching lever 60 is also operated by an outside handle lever 50 that is connected by suitable linkage for rotation by an outside door handle (not shown).

The Dzurko door latch also includes a locking lever 40 that is pivotally mounted on stud 28. Locking lever 40 is operated by an inside locking lever 80 that is pivotally mounted on the flange of the metal face plate 14 near the inside handle lever 56. The inside locking lever 80 is operated by an inside sill button or lock slide through a suitable linkage (not shown). Locking lever 40 is also operated by an outside locking lever 82 that is operated by a key lock cylinder through a suitable linkage (not shown). In some instances, for example in upscale automobiles, locking lever 40 is also power operated by a remotely controlled linear electric motor or the like in a well known manner (not shown).

The door latch disclosed in the Dzurko '461 patent is unlocked and unlatched in the following sequence. First, the locking lever 40 is moved to the unlocked position by the inside locking lever 80, the outside locking lever 82, or in the instance of a vehicle equipped with power door locks, a remotely controlled motor. This moves the intermittent lever 34 to the unlocked position. After the door latch is unlocked, the door latch is unlatched by moving the unlatching lever 60 via inside handle lever 56 or outside handle lever 50 to the unlatched position pulling intermittent lever 44 and detent 32 down to unlatch the vehicle door. The vehicle door then may be pushed or pulled open manually.

Door latches of the type disclosed in the Dzurko '461 patent have been used successfully by General Motors Corporation for many years.

However, there are instances where the unlatching operation is initiated prematurely reversing the normal sequence of unlocking and then unlatching the vehicle door latch. Of course, the vehicle door latch cannot be unlatched when in the locked condition. However, when the unlatching lever 60 moves to the unlatching position, the unlatching lever 60 blocks the intermittent lever 34 and prevents movement of the locking lever 40 to the unlocked position resulting in an impasse where the door latch cannot be unlocked or unlatched.

SUMMARY OF THE INVENTION

The object of this invention is to provide a vehicle door latch that has a locking mechanism and a latching mechanism and inside and outside handle levers for unlatching the vehicle door latch that cooperate with the locking mechanism and the latching mechanism so that the door latch can be unlocked and unlatched even if one of the handle levers is actuated prematurely and held in the unlatching position.

A feature of the vehicle door latch of the invention is that the vehicle door latch has inside and outside handle levers that unlatch the vehicle door latch independently of each other.

Another feature of the invention is that the vehicle door latch has an intermittent lever for unlatching the door latch and inside and outside handle levers that drive respective transfer members that drive the intermittent lever in an unlatching operation and yield to the intermittent lever in an unlocking operation.

Still another feature of the vehicle door latch of the invention is that the vehicle door latch has inside and outside handle levers for unlatching the vehicle door latch that operate independently of each other to permit an unlocking operation if the vehicle door latch is locked or to unlatch the vehicle door latch if it is unlocked.

Yet another feature of the vehicle door latch of the invention is that the vehicle door latch has an intermittent lever for unlatching the door latch and independently operating inside and outside handle levers that drive respective transfer members that yield to the intermittent lever in an unlocking operation and drive the intermittent lever in an unlatching operation.

Still yet another feature of the vehicle door latch of the invention is that the vehicle door latch has inside and outside transfer members that pivot and either drive an intermittent lever in an unlatching operation or yield to the intermittent lever in an unlocking operation.

These and other objects, features and advantages of the invention will become apparent from the description below, which is given by way of example with reference to the accompanying drawings.

DESCRIPTION OF THE PREFERRED EMBODIMENT

The Prior Art Door Latch

Figure 1:
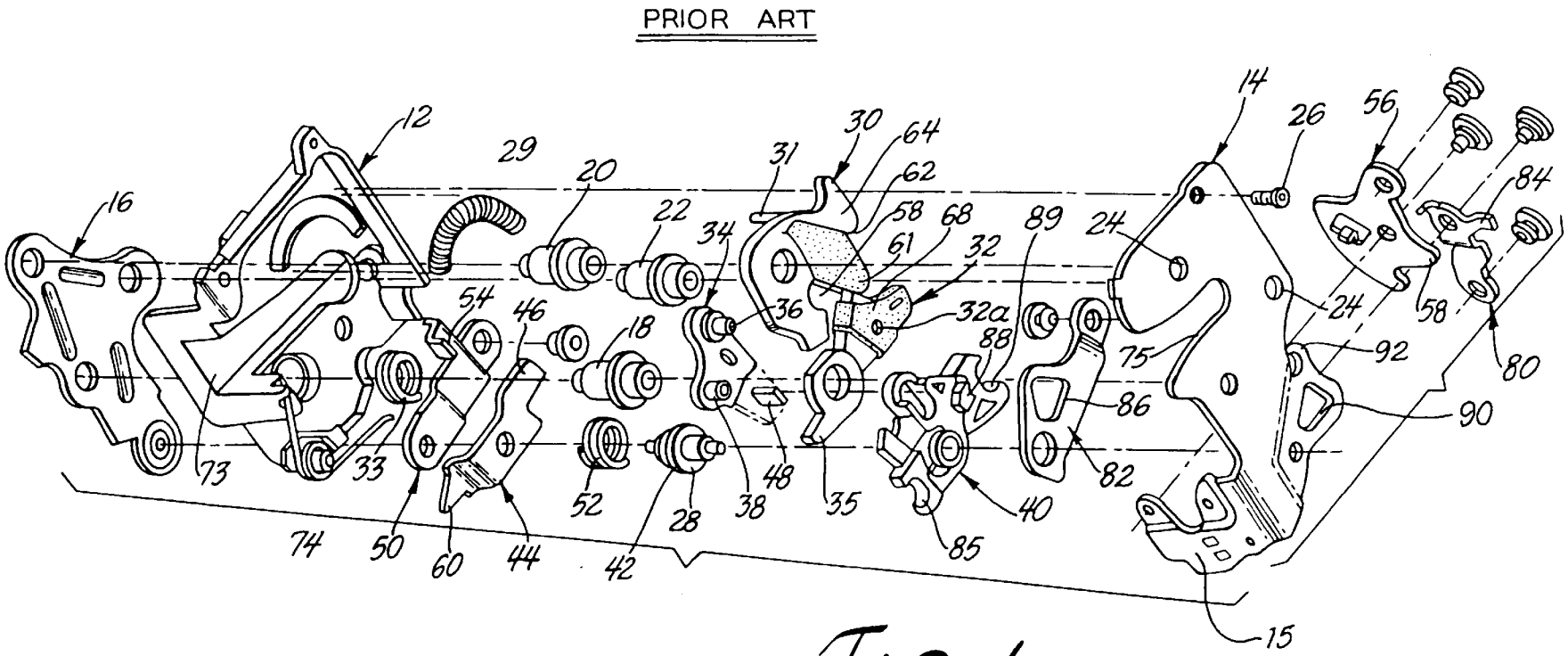
FIG. 1 is an exploded perspective front view of a prior art vehicle door latch.

Referring now to FIG. 1, the prior art vehicle door latch 10 has a multi-piece enclosure that comprises plastic housing 12, metal face plate 14 and metal back plate 16. The plastic housing 12 and the metal back plate 16 are held together by three flanged, internally threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Prior Art Latch Mechanism

The latch mechanism of the prior art vehicle door latch 10 comprises a fork bolt 30 and a cooperating detent 32 that are pivotally mounted on bushings 20 and 18 respectively and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30 and it engages a depending pin 31 of the fork bolt 30 at one end. Detent 32 is biased counterclockwise into engagement with the fork bolt 30 by a coil spring 33 that surrounds the bushing 18 and that has one end engaging an ear 35 of the detent 32. Detent 32 engages and holds the fork bolt lever 30 in a primary latched position against the bias of spring 29 as shown in FIG. 1. Detent 32 also can engage fork bolt 30 at 62 and hold it in an intermediate secondary latched position. Detent 32 engages fork bolt 30 at foot 64 in its unlatched position.

The latching mechanism further comprises an intermittent lever 34 for operating the detent 32. The intermittent lever 34 is located in the chamber of the plastic housing 12 behind detent 32. It has two integral pivot pins 36 and 38. Pivot pin 36 is journaled in a hole 32*a* in detent 32 so that the detent 32 rotates clockwise from the position shown in FIG. 1 (and out of latched engagement with the fork bolt 30) to the unlatched position when the intermittent lever 34 is pulled down. The pivot pin 38 is disposed in a slot of a locking lever 40 that pivots the intermittent lever 34 counterclockwise about pivot pin 36 from the unlock position shown in FIG. 1 to a lock position (not shown). The locking lever 40 is journaled on the stud 28 between the flange 42 and the face plate 14. Briefly, the locking lever 40 is rotated clockwise to lock the door latch 10 or counterclockwise to unlock the door latch. Clockwise rotation pivots intermittent lever 34 counterclockwise about pivot pin 36 to a position where it is uncoupled from and out of the path of travel of unlatching lever 44 as described below. A more complete description of the locking lever 40 and lock mechanism is given after the latching mechanism is described.

The latch mechanism further comprises unlatching lever 44 that is journaled on a reduced diameter portion of the stud 28 spaced rearwardly of the flange 42. The unlatching lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIG. 1.

The latch mechanism further comprises an outside handle lever 50 and a coil return spring 52. Handle lever 50 is also journaled on the reduced diameter portion of the stud 28 behind the unlatching lever 44. It has a bent tab 54 that engages the ear 46 of the unlatching lever 44 so that the outside handle lever 50 rotates the unlatching lever 44 clockwise when it is rotated clockwise on stud 28. Outside handle lever 50 is connected by suitable linkage for rotation by an outside door handle (not shown).

The coil return spring 52 is disposed around the stud 28 and located between the flange 42 and the unlatching lever 44. One end of the coil spring 52 engages the bottom of unlatching lever 44 and the other end engages the bottom of the plastic housing 12 above the unlatching lever 44 so that unlatching lever 44 and outside handle lever 50 are biased counterclockwise to a rest position where tab 54 engages the bottom of the plastic housing 12.

The latch mechanism further comprises an inside handle lever 56 that is pivotally mounted on a flange 15 of the metal face plate 14. Inside handle lever 56 has a tab 58 that engages a second ear 60 of unlatching lever 44 so that inside handle lever 56 also rotates unlatching lever 44 clockwise when it is rotated counterclockwise. Inside handle lever 56 is connected by suitable linkage for rotation by an inside door handle or other operator (not shown).

Fork bolt 30 has a conventional slot or throat 58 for receiving and retaining a strike member that is attached to the vehicle door pillar to latch the vehicle door in the closed position (not shown). Fork bolt 30 also includes a primary latch shoulder 61, an intermediate secondary latch shoulder 62 and a radially projecting foot 64. Fork bolt 30 preferably has a plastic coating that covers a surface of the slot 58 that is engaged by the striker for energy absorption and quiet operation when the vehicle door is slammed shut.

Detent 32 has a sector shaped catch 68 that engages the radially projecting foot 64 when the fork bolt 30 is in the unlatched position (not shown). The sector shaped catch 68 positively engages the primary and secondary latch shoulders 61 and 62 to hold the fork bolt 30 in either the primary or the intermediate secondary latched positions shown in FIG. 1 and not shown, respectively. Detent 32 also preferably includes a plastic coating that has an integral bumper. The bumper engages the bushing 22 to stop counterclockwise pivoting of the detent lever 32 under the bias of spring 52. This bumper also absorbs energy and quiets operation when the door is slammed shut.

The latch mechanism described above operates as follows. When the door latch 10 is in an unlatched and unlocked condition, fork bolt 30 is poised to receive a conventional strike member (not shown) that projects into aligned fish mouth slots 73 and 75 of the plastic housing 12 and the metal face plate 14 when the door is shut. The entering strike member engages the plastic coating at the back of the throat 58 and rotates fork bolt 30 counterclockwise against the bias of spring 29 until fork bolt 30 is rotated to the primary latch position shown in FIG. 1 where fork bolt 30 captures the striker in the throat 58. Fork bolt 30 is held in the primary latch position by catch 68 of detent 32 engaging the primary latch shoulder 61 of fork bolt 30.

Catch 68 rides along the periphery of the fork bolt 30 under the bias of spring 52 as fork bolt 30 rotates counterclockwise from the unlatched position to the primary latch position shown in FIG. 1. During this travel, catch 68 rides under the foot 64 into engagement with the intermediate secondary latch shoulder 62 and then under the coated portion into engagement with the primary latch shoulder 61. It is to be noted that the engagement of catch 68 with the intermediate secondary latching shoulder 62 is sufficient to hold the vehicle door closed in the event that the vehicle door is not shut with sufficient force so that catch 68 engages primary latch shoulder 61.

The vehicle door latch 10 is now latched but not locked so that the vehicle door can be opened simply by operating either an inside or outside door handle or the like to rotate the unlatching lever 44 clockwise moving the ear 46 down as viewed in FIG. 1. Ear 46 engages projection 48 of intermittent lever 34 and pulls the intermittent lever 34 down from the primary latch position shown in FIG. 1. As the intermittent lever 34 is pulled down, it rotates detent 32 clockwise against the bias of spring 52 from the primary latch position shown in FIG. 1. Fork bolt 30 is then free to rotate counterclockwise under the bias of spring 29 from the primary latch position shown in FIG. 1 to an unlatched position as the striker is pulled out of the aligned fish mouth slots 73 and 75 when the vehicle door is opened.

The Prior Art Lock Mechanism

The lock mechanism of door latch 10 is actuated by rotating the locking lever 40 that is journaled on stud 28 between flange 42 and face plate 14 clockwise. Clockwise rotation of the locking lever 40 rotates intermittent lever 34 counterclockwise about the pivot pin 36 that is journaled in the detent 32 due to the engagement of the second pivot pin 38 of the intermittent lever 34 in the slot of the locking lever. Intermittent lever 34 is thus rotated counterclockwise from the unlocked position shown in FIG. 1 to a locked position where projection 48 is repositioned out from under ear 46 of unlatching lever 44. Consequently, when the door handles or the like are operated so as to rotate the unlatching lever 44 clockwise to the unlatching position, the ear 46 simply bypasses the projection 48 without transferring any motion to the intermittent lever 34. Consequently, intermittent lever 34 is not pulled down to rotate detent 32 to the unlatch position. In other words, the unlatching lever 44 simply free wheels so that operation of the door handles or their equivalent is not effective.

The lock mechanism further comprises an inside locking lever 80 and an outside lock lever 82. Inside locking lever 80 is pivotally mounted on flange 15 of the metal face plate 14 at a location spaced from the pivot for the inside handle lever 56. Inside locking lever 80 has an ear 84 that fits in a slot 89 at one end of locking lever 40. Outside locking lever 82 is pivotally mounted on stud 28 in front of locking lever 40. Locking lever 40 has a protuberance 88 that projects through a sector shaped hole 86 in outside locking lever 82 and then through a smaller sector shaped hole 90 in face plate 14.

Protuberance 88 and sector shaped hole 90 limit rotation of locking lever 40 from an unlocked position shown in FIG. 1 where protuberance 88 engages the upper edge of hole 90 to a locked position (not shown) where protuberance 88 engages the lower edge of hole 90.

Locking lever 40 is rotated clockwise from the unlocked position shown in FIG. 1 to the locked position by rotating inside locking lever 80 counterclockwise as viewed in FIG. 1. Inside locking lever 80 is actuated by a suitable linkage system (not shown) for rotation by an inside sill button or other operator (not shown).

Locking lever 40 can also be rotated clockwise from the unlocked position shown in FIG. 1 to the locked position by rotating outside locking lever 82 clockwise. Outside locking lever 82 is generally actuated by a key lock cylinder through a suitable linkage (not shown). Outside locking lever 82 is an optional member that may be omitted in rear door applications that do not have a lock cylinder. Locking lever 40 also has a slot 85 for operating the locking lever 40 by power, for instance by a linear electric or vacuum motor.

The Prior Art Unlocking And Unlatching Operation

When locked vehicle door latch 10 is locked and latched, door latch 10 is unlocked and then unlatched by two distinct operators. First, unlocking lever 40 is rotated counterclockwise to the position shown in FIG. 1 either by a key lock cylinder (not shown) acting via outside locking lever 82, an inside sill button or the like (not shown) acting via inside locking lever 80 or a motor (not shown). This rotation moves tab 48 of intermittent lever 34 beneath ear 46 of unlatching lever 44. Door latch 10 is then unlatched by rotating unlatching lever 44 clockwise by a second distinct operator such as an outside door handle (not shown) acting via outside handle lever 50 or an inside door handle (not shown) acting via inside handle lever 56. This rotation pulls intermittent lever 34 down and releases detent 32 from lock bolt 30. This unlocking and unlatching operation requires manipulation of two distinct operators. Moreover the specific unlocking/unlatching sequence must be followed because premature operation of unlatching lever 44 blocks intermittent lever 34 in the locked position if unlatching lever 44 is actuated first.

The Vehicle Door Latch of the Invention

The vehicle door latch 100 of the invention is shown in FIGS. 2 through 10.

Vehicle door latch 100 includes essentially all of the components described above in connection with door latch 10 except for replacement of unlatching lever 44 and outside handle lever 50 that are pivotally mounted on stud 28. The remaining components of door latch 10 and door latch 100 are substantially identical. Corresponding components are identified with the same numerals in FIGS. 1 and 2–10.

Figure 2:
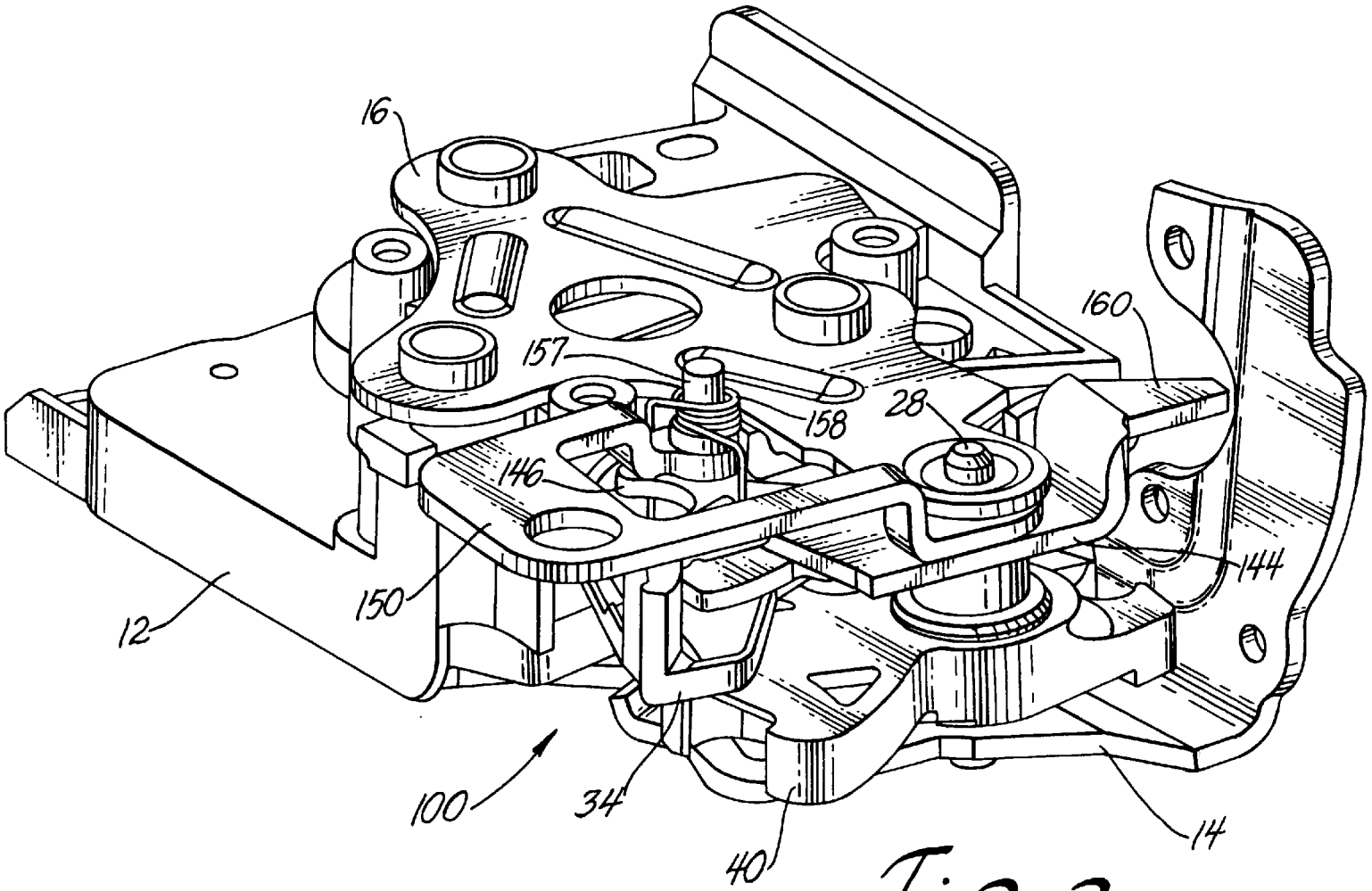
FIG. 2 is a perspective rear view of a vehicle door latch in accordance with the invention.
Figure 3:
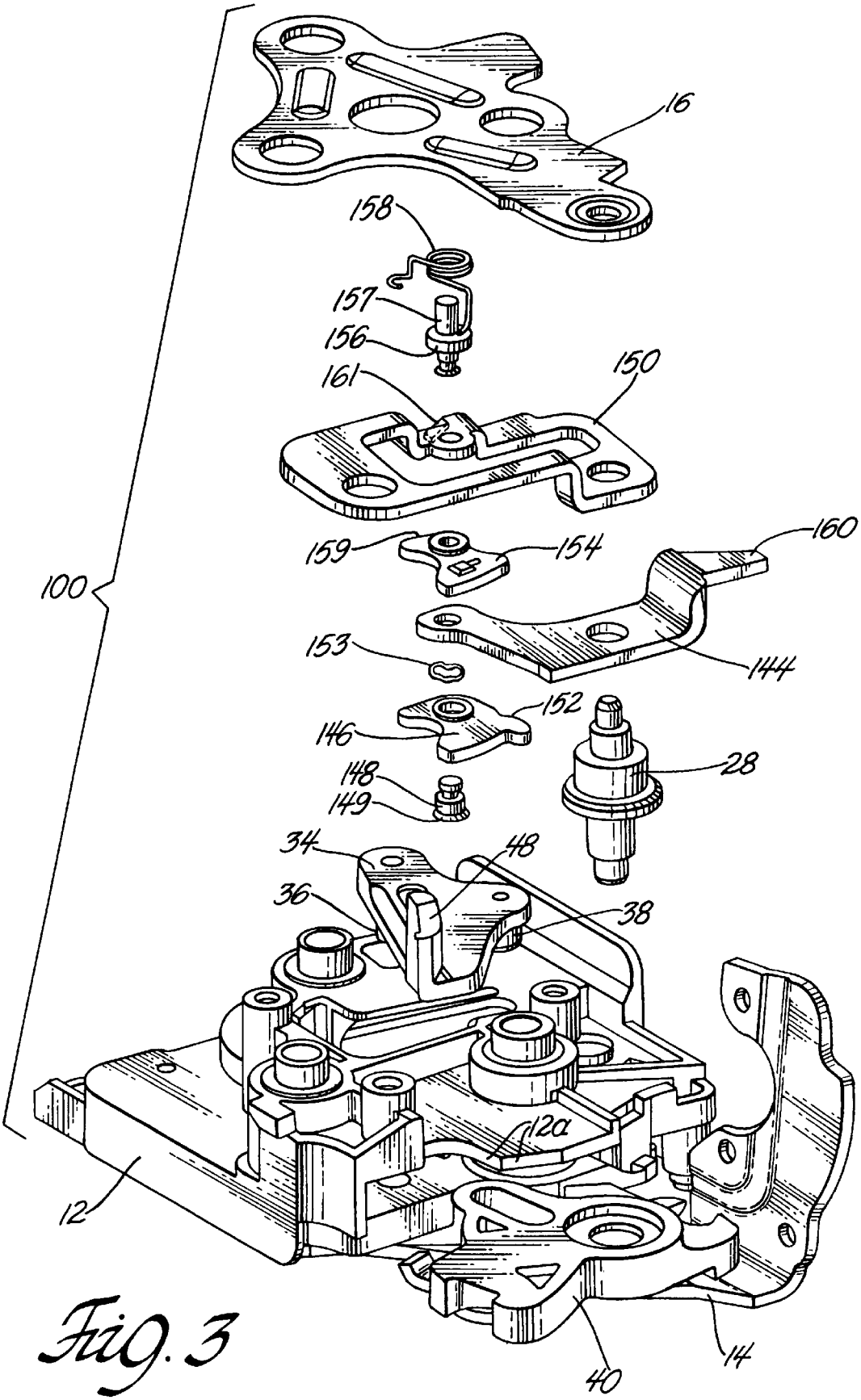
FIG. 3 is an exploded perspective rear view of the vehicle door latch shown in FIG. 2.

Referring now to FIGS. 2 and 3, vehicle door latch 100 comprises an unlatching lever 144, an inside transfer member 146 and a pivot pin 148 in place of unlatching lever 44;

and an outside handle lever 150, an outside transfer member 154, a pivot pin 156 and a coil spring 158 in place of outside handle lever 50.

Unlatching lever 144 and outside handle lever 150 are pivotally mounted on stud 28 and pivot on stud 28 independently of each other. Inside transfer member 146 pivots on unlatching lever 144 by means of pivot pin or rivet 148 that has a shank that extends through a journal hole in an elevated end of the unlatching lever 144 and headed at the end of the shank. Pivot pin 148 has a flat head 149 at the opposite end of the shank that rides on intermittent lever 34. A wavy spring washer 153 surrounds the shank of rivet 148 and fits between transfer member 146 and unlatching lever 144 in a compressed state. Spring washer 153 acts as a friction clutch that maintains the pivotal position of transfer member 146 with respect to unlatching lever 144.

Unlatching lever 144 is generally horizontal in the latched position and transfer member 146 hangs vertically from the elevated end of unlatching lever 144 in an armed position maintained by the frictional resistance of spring washer 153. Inside transfer member 146 includes a cam surface 152 that cooperates with surfaces 12a of housing 12 to insure that inside transfer member 146 is in the armed position when unlatching lever 144 is in the latched position as explained below.

Outside transfer member 154 pivots on outside handle lever 150 by means of pivot pin 156 that has a medial collar and a depending shank. The depending shank extends through a journal hole in the middle of outside handle lever 150, a journal hole in the outside transfer member 154 and is headed at the end of the shank. Pivot pin 156 has a projecting post 157. Coil spring 158 surrounds post 157 and has one end engaging outside handle lever 150 and the other end anchored in a hole in outside transfer member 154 so that coil spring 158 biases outside transfer member 154 clockwise away from stud 28 until stop 159 on the top surface of transfer member 154 engages stop tab 161 of outside handle lever 150.

Inside handle lever 56, inside locking lever 80 and outside locking lever 82 are not shown in FIGS. 2–10 of vehicle door latch 100 in the interest of clarity. The relationship and operation of these parts is clear from the prior art door latch 10 shown in FIG. 1.

The Conventional Unlocking and Unlatching Operation

Door latch 100 can be unlocked and unlatched in a conventional manner using separate operators for the latching mechanism and the locking mechanism. Like prior art door latch 10, door latch 100 is still unlocked by manipulating locking lever 40 by inside locking lever 180, outside locking lever 182 or a motor in the case of power door locks.

The unlatching of door latch 100 is somewhat similar to the unlatching of door latch 10 yet unique. For inside unlatching, intermittent lever 34 is pulled down by inside handle lever 56 (FIG. 1) rotating unlatching lever 144 (FIG. 3) to push down on tab 48 of intermittent lever 34 through inside transfer member 146 which is vertically positioned by housing 12 and spring washer 153. Inside transfer member 146 is preferably shaped so that tab 48 does not apply any significant torque to transfer member 146 counterclockwise when tab 48 is pushed down.

For outside unlatching, intermittent lever 34 is pulled down by rotating outside handle lever 150 to push down on tab 48 of intermittent lever 34 through outside transfer member 154 without any assistance of unlatching lever 144. Outside transfer member 154 is preferably shaped so that tab 48 torques transfer member 154 counterclockwise against stop tab 161 when tab 48 is pushed down.

Unlocking and unlatching in sequence is conventional and characteristic of the prior art door latch 10 as explained above. However, door latch 100 can also be unlocked and unlatched when the latching mechanism is operated prematurely and either the inside handle lever or the outside handle lever is held in the unlatched position. This is generally accomplished by using the handle lever that is free. Thus, the door latch 100 can be unlocked and unlatched from inside the vehicle when the outside door handle (and outside handle lever) is stuck in the unlatched position and the inside door handle and inside handle lever are free or from outside the vehicle when the inside door handle (and inside handle lever) is stuck in the unlatched position and the outside door handle and the outside handle lever are free.

The Unlocking and Unlatching Operation with a Stuck Door Handle

Door latch 100 can be unlocked and unlatched when the unlatching operation is initiated prematurely by either the inside or the outside door handle which is then stuck in the unlatched position.

The unlocking and unlatching operation with a stuck outside door handle is as follows.

Figure 4C:
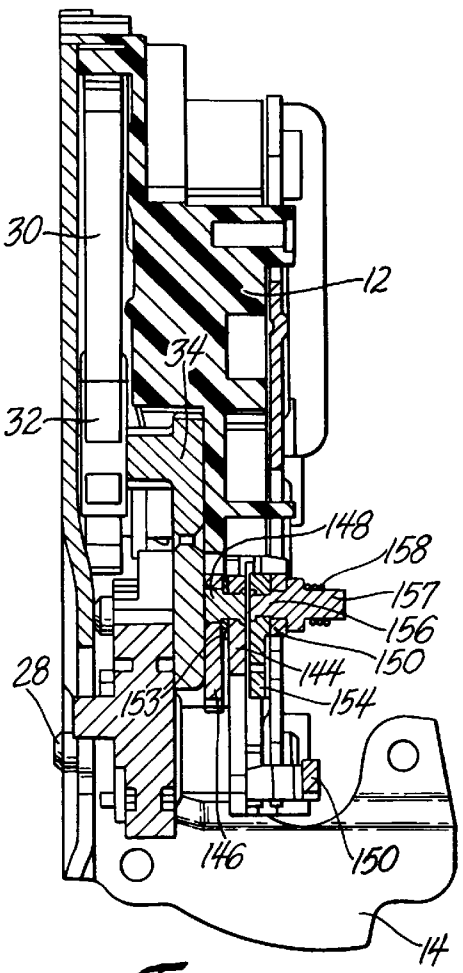
FIG. 4C is section taken substantially along the line 4—4 of FIG. 4A looking in the direction of the arrows.
Figure 4B:
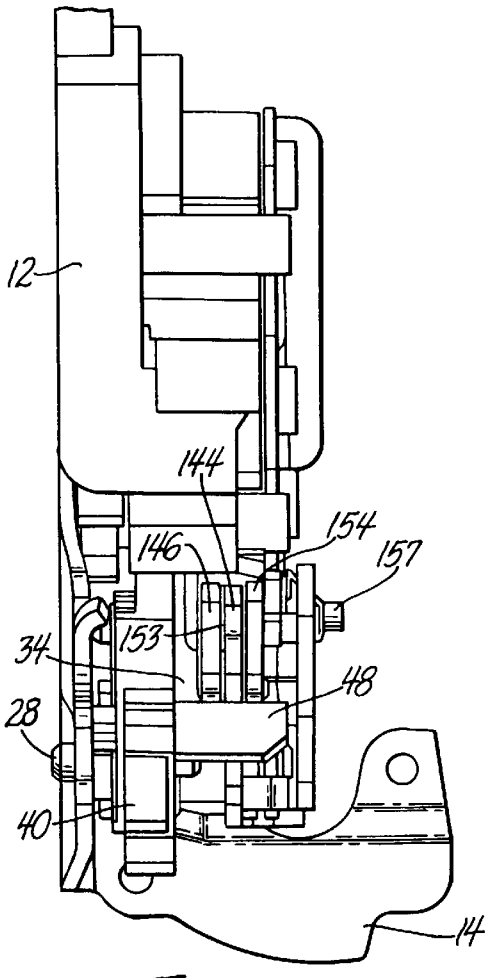
FIG. 4B is a left side view of the door latch shown in FIG. 4A.
Figure 4A:
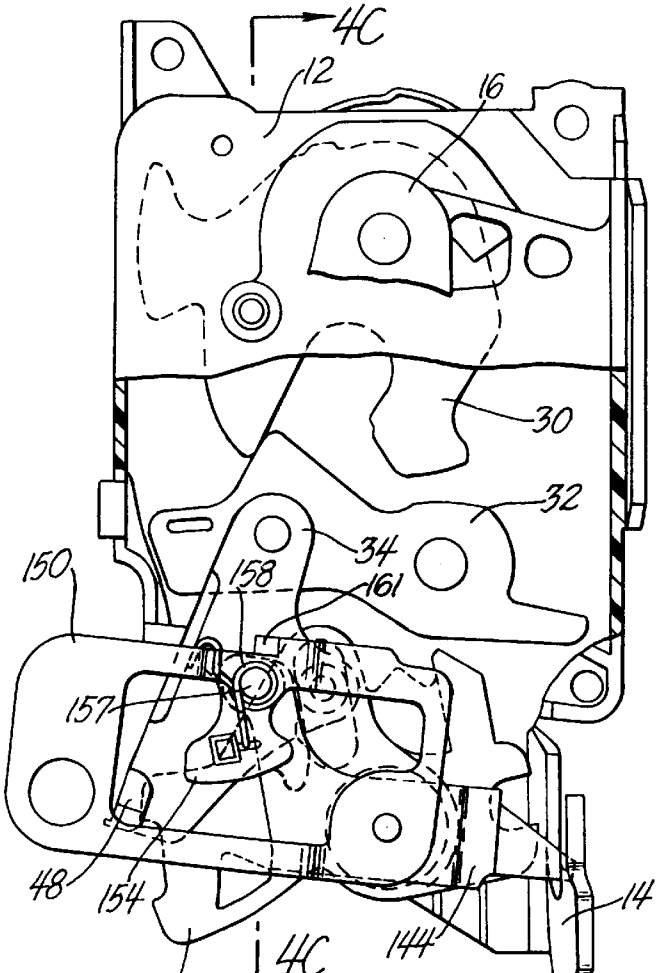
FIG. 4A is a fragmentary rear view of the vehicle door latch of FIG. 2 showing various parts when the door latch is locked and latched.
Figure 5A:
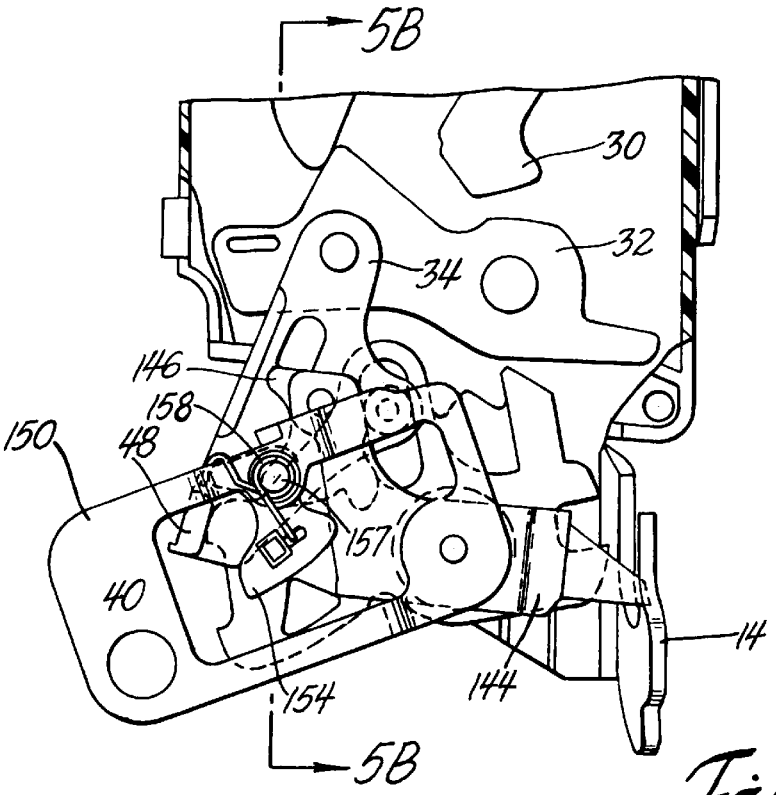
FIG. 5A is a fragmentary rear view of the vehicle door latch of FIG. 2 showing the parts after a premature unlatching operation by an outside door handle (or the like connected to the outside handle lever of the door latch) that is stuck in the unlatched position.
Figure 5B:
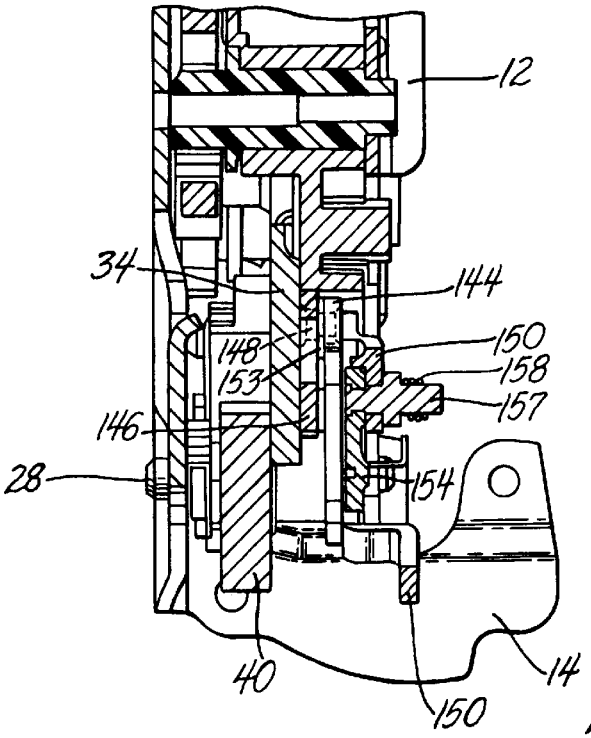
FIG. 5B is a section taken substantially along the line 5—5 of FIG. 5A looking in the direction of the arrows.
Figure 6A:
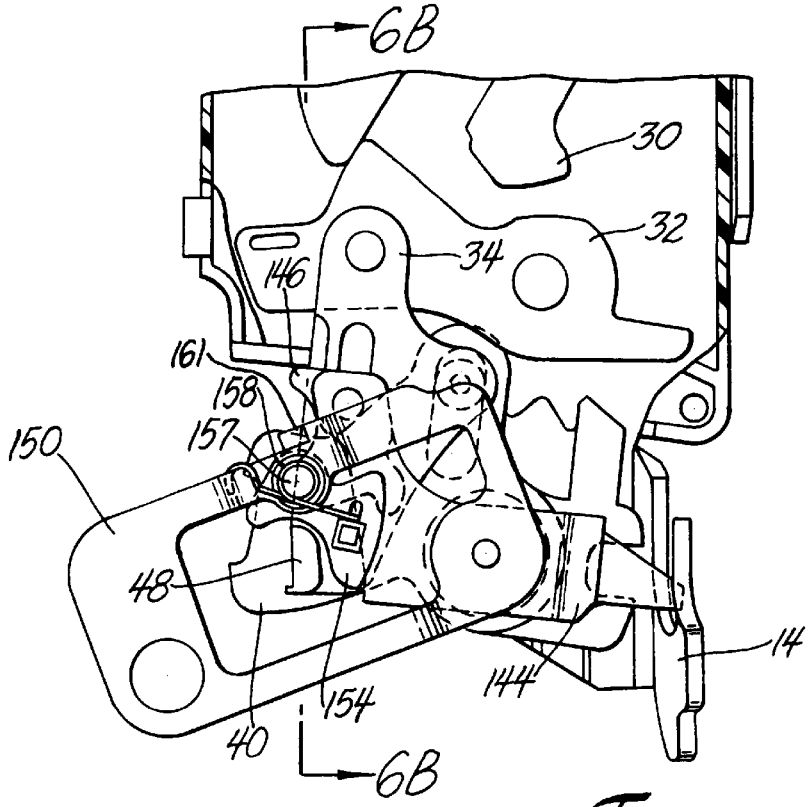
FIG. 6A is a fragmentary rear view of the vehicle door latch of FIG. 2 showing the parts after a premature unlatching operation by an outside door handle (or the like connected to the outside handle lever of the door latch) that is stuck in the unlatched position and an unlocking operation while the outside door handle is stuck.
Figure 6B:
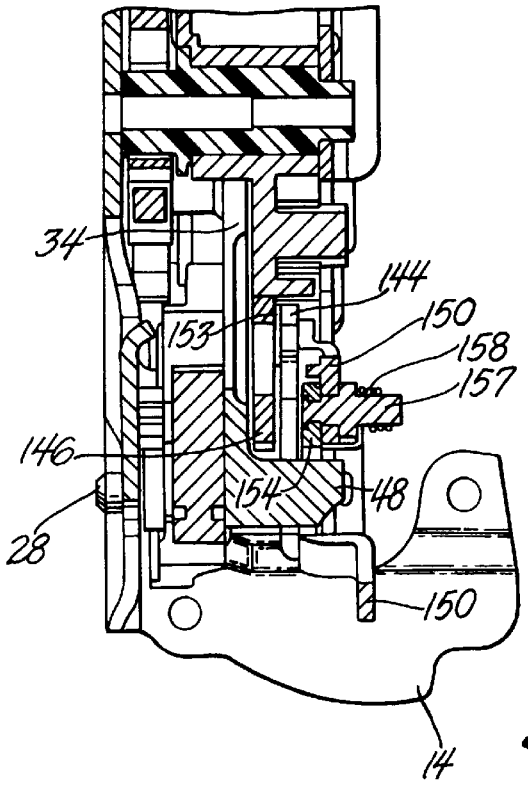
FIG. 6B is a section taken substantially along the line 6—6 of FIG. 6A looking in the direction of the arrows.

FIGS. 4A, 4B and 4C are fragmentary rear, side and section views of door latch 100 in a latched and locked condition. In the premature operation of the outside door handle, outside handle lever 150 is pivoted counterclockwise from the latching position shown in FIGS. 4A, 4B and 4C to the unlatching position shown in FIG. 5A and 5B. During this movement, outside handle lever 150 and transfer member 154 bypass tab 48 of intermittent lever 34 and stay in the unlatched position. Thus., vehicle door latch 100 is still locked and latched. Vehicle door latch 100 is now unlocked by rotating locking lever 40 clockwise from the locked position shown in FIGS. 5A and 5B to the unlocked position shown in FIGS. 6A and 613 via inside locking lever 80, outside locking lever 82 or a motor (not shown). Locking lever 40 in turn rotates intermittent lever 34 counterclockwise from the locked position shown in FIGS. 5A and 5B to the unlocked position shown in FIGS. 6A and 6B. As intermittent lever 34 swings counterclockwise, tab 48 engages transfer member 154 and rotates it counterclockwise against the action of spring 158 from the armed position shown in FIGS. 5A and 5B to the disarmed position shown in FIGS. 6A and 6B. Vehicle door latch 100 is now unlocked but still latched.

Figure 7B:
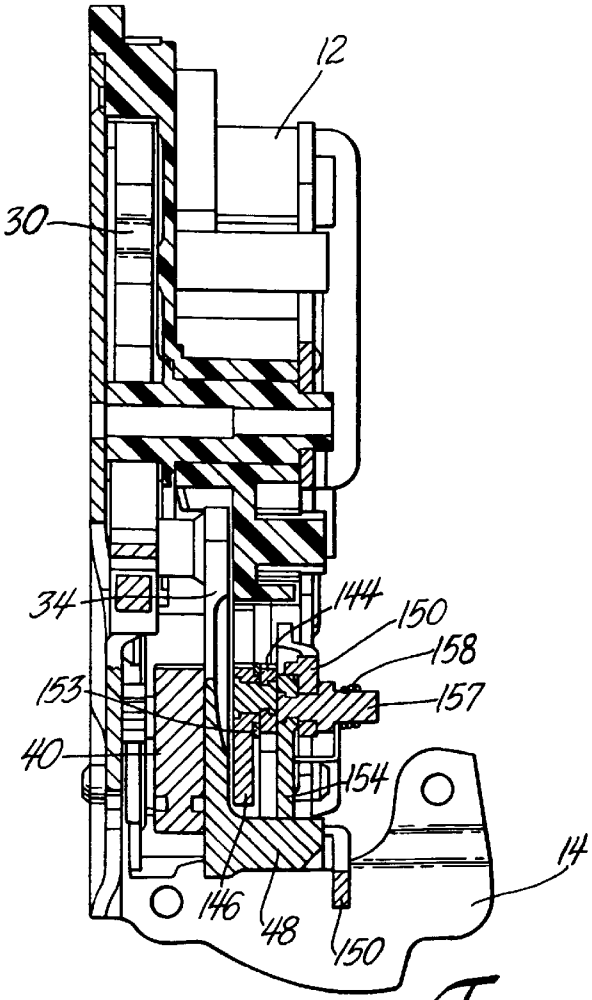
FIG. 7B is a section taken substantially along the line 7—7 of FIG. 7A looking in the direction of the arrows.
Figure 7A:
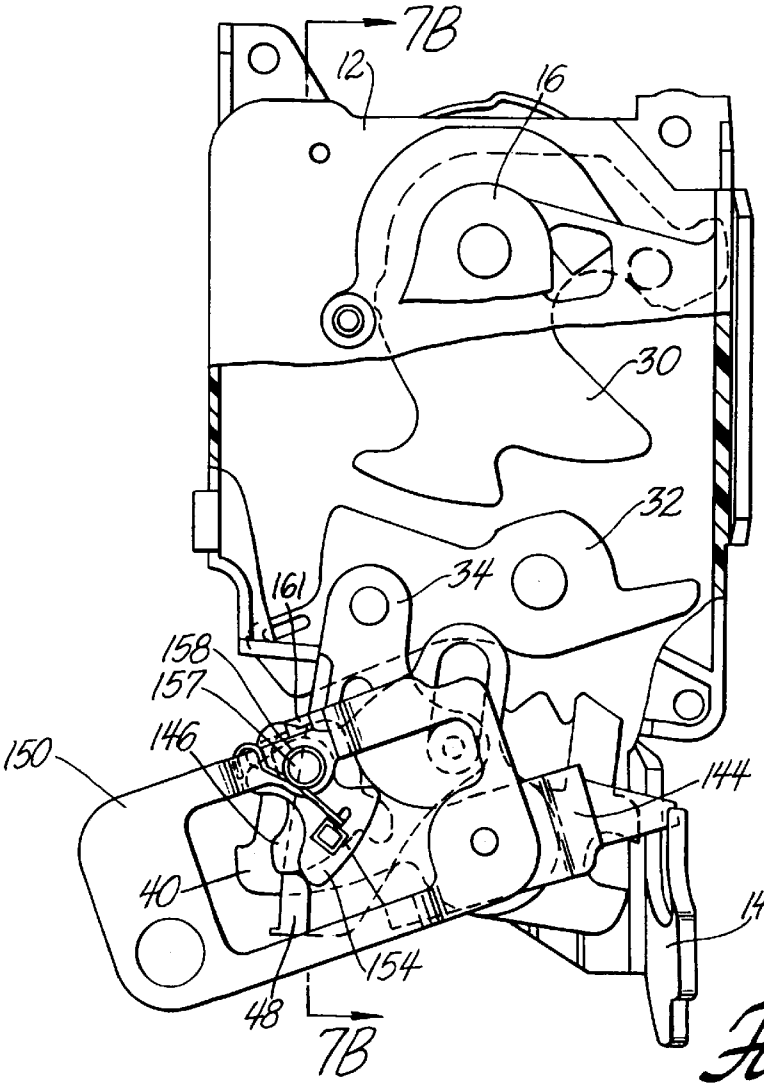
FIG. 7A is a fragmentary rear view of the vehicle door latch of FIG. 2 showing the parts after a premature unlatching operation by an outside door handle that is stuck in the unlatched position and then an unlocking operation and an unlatching operation by the inside door handle (or the like connected to the inside handle lever) while the outside door handle is stuck.

The unlocked door latch 100 is then unlatched by manipulating an inside door handle or the like (not shown) to rotate unlatching lever 144 counterclockwise to the unlatched position shown in FIGS. 7A and 7B via inside handle lever 56 (FIG. 1). When unlatching lever 144 rotates counterclockwise, transfer member 146 engages the top of tab 48 and pulls intermittent lever 34 down from the latched position shown in FIGS. 6A and 6B to the unlatched position shown in FIG. 7A and 7B. When intermittent lever 34 is pulled down, detent 32 is rotated counterclockwise releasing fork bolt 30 and the vehicle door may be pushed open manually from inside the vehicle.

The unlocking and unlatching operation with a stuck inside door handle is similar.

As indicated above, FIGS. 4A, 4B and 4C are fragmentary rear, side and section views of door latch 100 in a locked and latched condition. In the premature operation of the inside door handle, unlatching lever 144 is pivoted counterclockwise from the latching position shown in FIGS. 4A, 4B and 4C to the unlatching position shown in FIG. 8 by inside handle lever 56 (FIG. 1). During this movement, unlatching lever 144 and transfer member 146 bypass tab 48 of intermittent lever 34. Thus, vehicle door latch 100 is still locked and latched.

Figure 8:
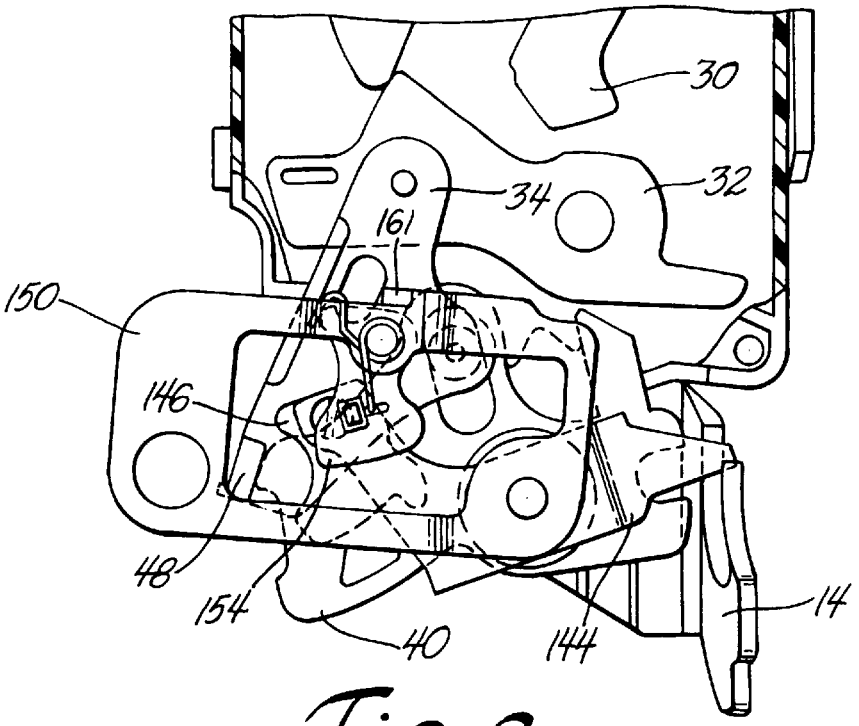
FIGS. 8–10 are fragmentary rear views of the vehicle door latch of FIG. 2 showing various states of operation when the vehicle door latch is unlocked and unlatched while the inside handle lever is stuck in the unlatched position.
Figure 9:
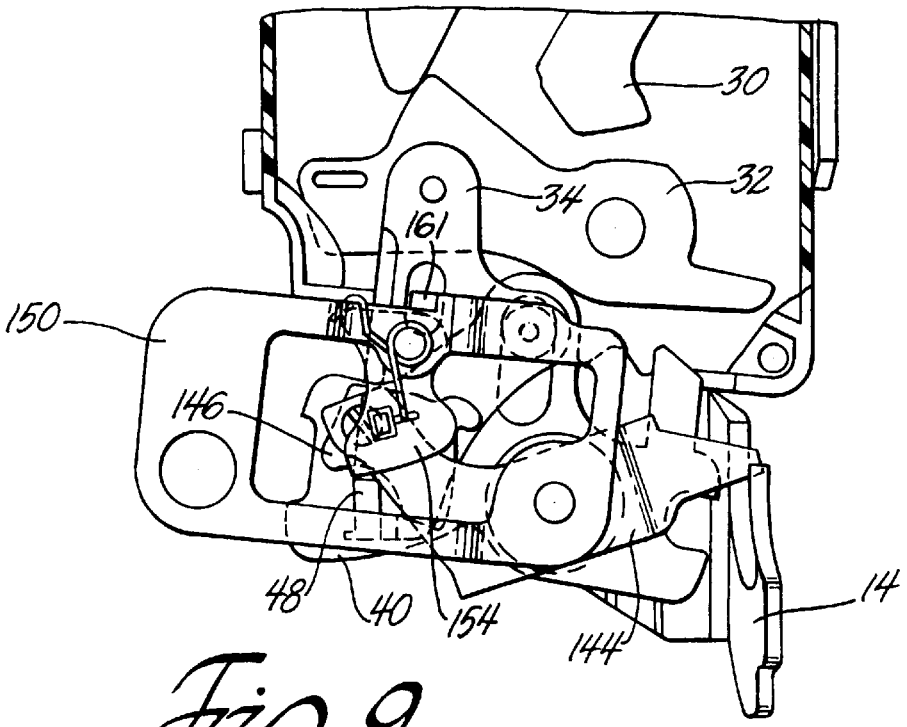

Vehicle door latch 100 is now unlocked by rotating unlocking lever 40 from the locked position shown in FIG. 8 to the unlocked position shown in FIG. 9 via inside locking lever 80, outside locking lever 82 or a motor (not shown). Locking lever 40 in turn swings intermittent lever 34 from the locked position shown in FIG. 8 to the unlocked position shown in FIG. 9. In moving to the unlocked position shown in FIG. 9, intermittent lever 34 engages transfer member 146 and moves it against the frictional bias of wave spring washer 153 from the armed position shown in FIG. 8 to the disarmed position shown in FIG. 9.

Figure 10:
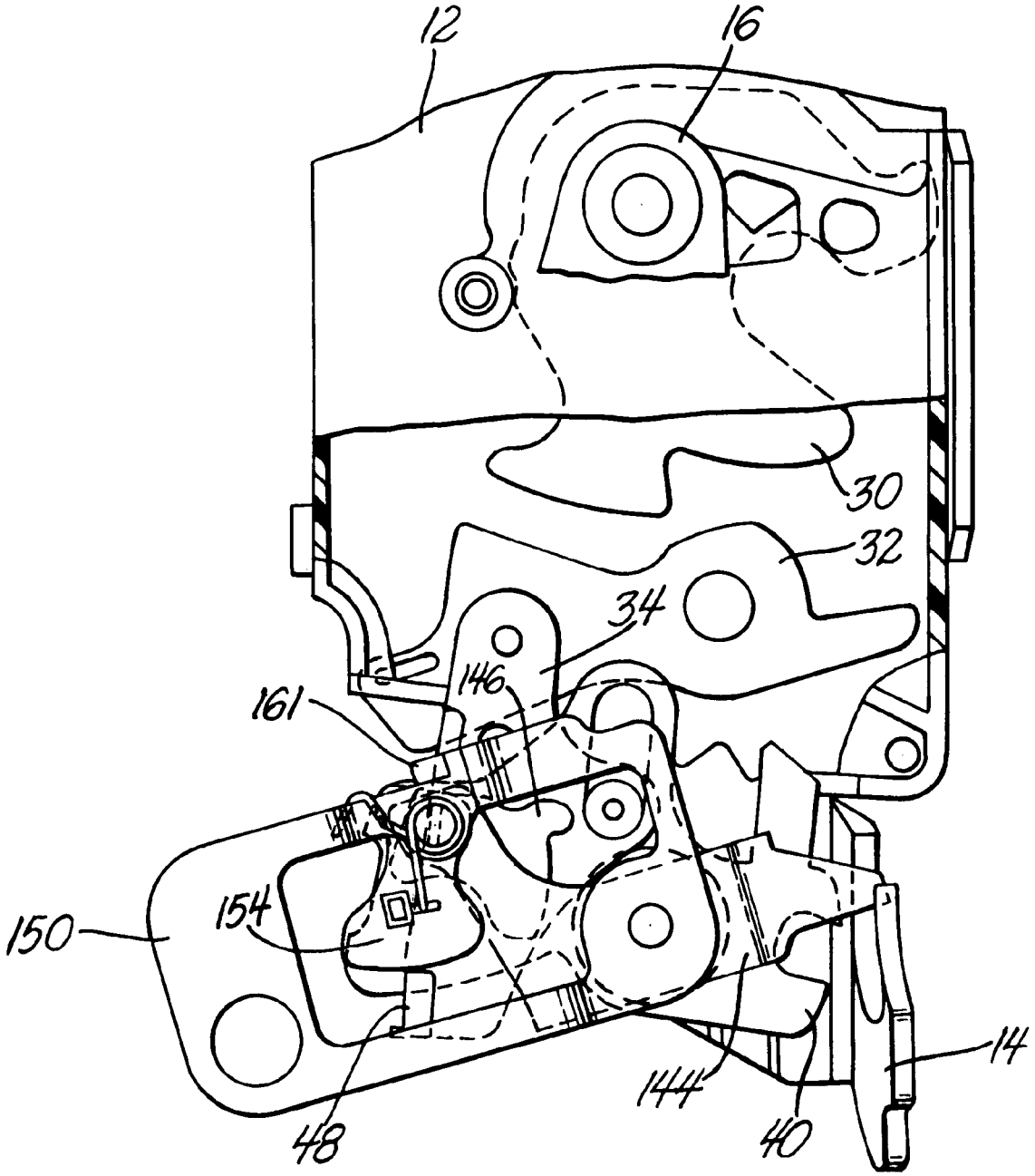

The unlocked door latch is then unlatched by manipulating an outside door handle or the like (not shown) to rotate outside handle lever 150 from the latched position shown in FIG. 9 to the unlatched position shown in FIG. 10. When outside handle lever 150 rotates counterclockwise, transfer member 154 engages the top of tab 48 and pulls intermittent lever 34 down from the latched position shown in FIG. 9 to the unlatched position shown in FIG. 10. When intermittent lever 34 is pulled down, detent 32 is rotated counterclockwise releasing fork bolt 30 and the vehicle door (not shown) may be pulled open manually from outside the vehicle. Transfer member 146 is rearmed by housing surfaces 12*a* which cam the transfer member 146 clockwise against the frictional bias of wave spring washer 153 when unlatching lever is returned to the latched position shown in FIGS. 4A, 4B and 4C.

Thus, the vehicle door can be opened when the vehicle door latch is locked and one door handle or other operator is stuck in an unlatched position. When the outside door handle is stuck, the inside door handle is used to unlatch the vehicle door latch. When the inside door handle is stuck, the outside door handle is used to unlatch the door. In either case, the vehicle door latch is unlocked using any available means, such as a key lock cylinder, sill button, or power door lock control switch or transmitter. The available means will usually but not necessarily always be inside the vehicle when the outside door handle is stuck and outside the vehicle when the inside door handle is stuck.

It should be noted that intermittent lever 34 is operated either by the inside door handle and the outside door handle through independent linkage systems that operate on tab 48. Consequently, tab 48 projects under both transfer member 146 and transfer member 154.

Many modifications and variations of the present invention in light of the above teachings may be made. It is, therefore, to be understood that, within the scope of the appended claims, the invention may be practiced otherwise than as specifically described.

We claim:

1. A vehicle door latch having a locking mechanism and a latching mechanism comprising:

the locking mechanism including an intermittent lever for unlatching the door that moves between a locked position and an unlocked position and that moves between a latched position and an unlatched position when in the unlocked position;

the latching mechanism including a first transfer member that moves between a latching position and an unlatching position and between an armed position and an unarmed position when in the unlatching position and an inside handle lever that drives the first transfer member;

the latching mechanism further including a second transfer member that moves between a latching position and an unlatching position and between an armed position and an unarmed position when in the unlatching position and an outside handle lever that drives the second transfer member;

the intermittent lever engaging and moving a selected one of the first and second transfer members to an unarmed position when the intermittent lever is moved to the unlocked position while the selected transfer member is in the unlatched position;, and a non-selected one of the first and second transfer members engaging the intermittent lever and moving the intermittent lever to the unlatched position when the said non-selected transfer member is moved to the unlatched position and the intermittent lever is in the unlocked position whereby the door latch may be unlocked and unlatched with either the inside handle lever or the outside handle lever stuck in an unlatched position before the door latch is unlocked.

2. An automotive vehicle door latch according to claim 1 wherein the intermittent lever has a tab that engages the selected transfer member to move the selected transfer member when the intermittent member is moved to the unlocked position and that is engaged by the said non-selected transfer member to move the intermittent lever to the unlatched position.

3. The vehicle door latch according to claim 2 wherein the second transfer member is substantially parallel to the first transfer member.

4. The vehicle door latch according to claim 3 wherein the inside handle lever drives the first transfer member via an unlatching lever and wherein the first transfer member pivots between the armed position and the unarmed position on the unlatching lever.

5. The vehicle door latch according to claim 3 wherein the second transfer member pivots between the armed and the unarmed positions.

6. The vehicle door latch according to claim 4 wherein the second transfer member pivots between the armed and the unarmed positions.

7. A vehicle door latching having a locking mechanism and a latching mechanism comprising:

the locking mechanism including an interminent lever for unlatching the door that moves between a locked position and an unlocked position and that moves between a latched position and an unlatched position when in the unlocked position;

the latching mechanism including an unlatching lever moves between a latching position and an unlatching position, a first transfer member pivotally mounted on the unlatching lever that pivots between an armed position and an unarmed position when the unlatching lever is in the unlatching position and an inside handle lever that drives the unlatching lever;

the latching mechanism further including an outside handle lever that moves between a latching position and unlatching position and a second transfer member pivotally mounted on the outside handle lever that pivots between an armed position and an unarmed position when the outside handle lever is in the unlatching position;

the intermittent lever engaging and moving a selected one of the first and second transfer members to an unarmed position when the intermittent lever is moved to the unlocked position while the selected transfer member is in the unlatched position; and a non-selected one of the first and second transfer members engaging the intermittent lever and moving the intermittent lever to the unlatched position when the said non-selected transfer member is in the armed position and its associated lever is moved to the unlatched position and the intermittent lever is in the unlocked position whereby the door lock may be unlocked and unlatched with either the inside handle lever or the outside handle lever stuck in an unlatched position before the door latch is unlocked.

8. An automotive vehicle door latch according to claim 7 wherein the intermittent lever has a tab that engages the selected transfer member to move the selected transfer member when the intermittent member is moved to the unlocked position and that is engaged by the non-selected transfer member to move the intermittent lever to the unlatched position.

9. The vehicle door latch according to claim 8 wherein the tab extends below the first transfer member and the second transfer member when the unlatching lever and the outside handle lever are in their respective latching positions.

10. The vehicle door latch according to claim 9 wherein the first transfer member and the second transfer member move in parallel planes.

11. The vehicle door latch according to claim 9 wherein the unlatching lever and the outside handle lever both pivot on a common axis for movement between their respective latching positions and unlatching positions.

* * * * *